United States Patent [19]

Bianchetto et al.

[11] 4,455,190

[45] Jun. 19, 1984

[54] WEB SPLICER

[75] Inventors: Peter E. Bianchetto, Foxboro; John H. Frohock, Brockton, both of Mass.

[73] Assignee: Butler Automatic Inc., Canton, Mass.

[21] Appl. No.: 495,301

[22] Filed: Apr. 20, 1983

[51] Int. Cl.[3] ..... B65H 19/14; B65H 19/18

[52] U.S. Cl. ..... 156/504; 156/505; 242/56 R; 242/58.3; 242/58.5

[58] Field of Search ..... 156/159, 502, 504, 505; 242/56 R, 58.1, 58.3, 58.4, 58.5

[56] References Cited

U.S. PATENT DOCUMENTS

| | | | |
|---|---|---|---|
| 3,841,944 | 10/1974 | Harris, Jr. | 242/58.1 |
| 3,858,819 | 1/1975 | Butler, Jr. | 242/58.3 |
| 4,190,483 | 2/1980 | Ryan et al. | 156/504 |
| 4,284,463 | 8/1981 | Wright | 156/504 |
| 4,331,301 | 5/1982 | Martinez | 242/58.1 |

*Primary Examiner*—Michael G. Wityshyn
*Attorney, Agent, or Firm*—Cesari and McKenna

[57] ABSTRACT

An improved splicing apparatus has a splicer head comprising a pair of opposed upper and lower traveling carriages each of which supports an idler roller, a nip bar which is swingable on its carriage between a ready position downstream from its corresponding idler roller and a web preparation position at the front of the splicer head and means for pushing the nip bar towards the opposite nip bar when both carriages are in their advanced positions. A knife carriage located on the head between the two nip bar carriages retracts when either nip bar carriage retracts to permit the nip bar on the opposite carriage to be swung to its web preparation position. The knife carriage supports a knife which can be actuated momentarily to urge it from a normal retracted position to an advanced position wherein it intercepts one of the nip bars when that nip bar is in its splicing position against the opposite nip bar. The present splicer facilitates preparation of a ready web in a quick convenient and safe manner and it also produces splices between webs having little or no tails in a reliable and efficient manner.

8 Claims, 10 Drawing Figures

WEB SPLICER

This invention relates to a web splicer. It relates more particularly to a web splicer which connects the trailing end of a running web to the leading end of a ready web so that the web can proceed uninterruptedly to a web-consuming machine.

BACKGROUND OF THE INVENTION

1. Field of the Invention

Splicers of this general type support a pair of web rolls which alternately feed a web to a web-consuming machine which may be a printing press, for example. While web is being drawn from one roll to the machine, the leading edge of the other roll is prepared and located at the proper position in the splicer's splicer head. When the running web is about to expire, a splice ready sequence is initiated which brakes the running web to a halt, presses the prepared leading end of the ready web against the stationary running web, severs the running web just upstream of the splice and then accelerates the web up to line speed so that it now draws from the roll of ready web. A web festoon or accumulator is located between the splicer head and the downstream press or other web-consuming machine so that that machine can operate continuously during the splice sequence drawing its web requirements from the accumulator. Following the splice sequence, the accumulator is refilled with web and the empty roll core replaced with a fresh roll whose leading edge is prepared and positioned in the splicer head for the next splice sequence.

2. The Prior Art

Prior splicers of this general type are disadvantaged because they do not permit the operator to prepare the ready web for splicing in a quick and convenient fashion, while at the same time protecting the operator from dangerous splicer parts including the web cutting knife. Those prior splicing apparatus which do try to treat those problems tend to be complicated and therefore relatively expensive to make and to maintain.

Also, in many applications, it is desirable or even necessary that the splice formed by the splicer have a short "tail" to minimize downstream tension upsets and web wastage. Indeed, in some cases, a lap splice is desired in which there is no tail at all. Such splices require that the running web be severed by the cutting knife in the splicer head very close to or even at the splice between the leading end of the ready web and the running web. In many prior splicers, this cannot be accomplished while still achieving the first-mentioned important objectives of operator convenience and safety.

SUMMARY OF THE INVENTION

Accordingly, it is an object of the present invention to provide a web splicing apparatus which is quite convenient and safe to use.

A further object of the invention is to provide such splicer apparatus which can produce a splice with minimum or no tail at the splice.

Still another object of the invention is to provide web splicing apparatus which is relatively inexpensive to make and to maintain in use.

Another object of the invention is to provide splicer apparatus whose splicing head is readily accessible at the front of the splicer.

Yet another object of the invention is to provide a splicer whose splicing head is composed of a minimum number of different parts to minimize inventory costs.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, in accordance with the invention, our splicing apparatus includes a splicer head positioned transverse to the path of web travel to the web-consuming machine and with the front of the splicer head defining an imaginary web prep plane which is readily accessible to the operator.

The splicer head comprises mirror image upper and lower retractable nip bar carriages. Each carriage includes an idler roller located right at the front of the splicer head adjacent the web prep plane. The splicer apparatus is arranged to support at least two web rolls. The web drawn from one roll is trained around the idler roller in the upper carriage in the splicer head and the web from the second roll is trained around the idler roller in the lower carriage. Whichever web constitutes the running or traveling web follows a path through the splicer head to the web-consuming machine by way of a web accumulator or festoon which normally stores a length of web to supply the needs of the web-consuming machine when the web passing through the splicer head is stopped during a splice sequence.

The upper carriage, in addition to the idler roller, carries a vacuum nip bar spaced downstream from the idler roller at a ready position and supported at its opposite ends by a pair of arms which are pivotally connected to the upper carriage adjacent to the web prep plane. When the lower carriage is retracted from the web prep plane, the nip bar on the upper carriage is swung between the ready position and a web preparation position wherein the nip bar is located at the front of the splicer head right at the web prep plane.

The lower carriage likewise supports a vacuum nip bar which is swingably connected at its opposite ends to that carriage. Thus the lower nip bar will assume a ready position wherein it is positioned downstream from the lower idler roller and directly opposite the upper nip bar when that is in its ready position. Also, when the upper carriage is in its retracted position, the lower nip bar is swung upwards from its ready position to a web preparation position right at the accessible web prep plane of the splicer head. Thus the running web, whether it is being drawn around the upper idler roller or the lower idler roller, passes between the upper and lower nip bars when they are in their ready positions to the web-consuming machine by way of the web accumulator.

The splicer head upper carriage also carries upper nip bar pistons. When both carriages are in their normal or advanced positions and both nip bars are in their ready positions, when the upper nip pistons are actuated, they push the upper nip bar downward against the lower nip bar. Likewise, the lower carriage supports lower nip bar pistons. When the two carriages are in their advanced positions and both nip bars are in their ready positions, when those lower pistons are actuated, they press the lower nip bar against the upper nip bar.

The third major section of the splicer head is a knife carriage which is located between the aforementioned upper and lower carriages. The knife carriage is arranged to retract when either one of the upper and lower carriages retracts. The knife carriage supports a transverse knife bar whose cutting edge is located in a plane lying between the upper and lower nip bars when those members are in their ready positions. The knife bar is movable between a retracted position wherein its edge lies just forwardly of the nip bars and an advanced or cutting position which it can assume when either the upper or lower nip bar is in its splicing position in which event the knife edge projects into a brush located in the side of the operative nip bar. Pistons acting between the knife carriage and the bar move the bar between its two positions.

During operation of the present splicer, web travels from one of the web rolls in the splicer around one of the idler rollers in the splicer head to the web-consuming machine. Assume, for example, that the web is traveling around the upper idler roller in the upper carriage section. As the web from the upper roll is being consumed, the operator readies the system for the expiration of that web by preparing the leading edge of a web from a fresh lower web roll mounted on the splicer. In this, he initiates a web preparation sequence which causes the upper carriage in the splicer head to retract away from the web prep plane to a location set back from that plane sufficient to permit the nip bar on the lower carriage to be swung automatically from its ready position to its web preparation position at the front of the splicer head.

As the upper carriage is retracted, the knife carriage also retracts to provide clearance for the aforesaid movement of the lower nip bar. These retractions of the upper carriage and the knife carriage do not interfere at all with the travel of the web around the upper idler roller to the web-consuming machine.

Next, the lower nip bar on the lower carriage is swung automatically to its preparation position at the web prep plane so that it is readily accessible to the operator. The operator then manually carries the leading edge of the web from the ready roll and places it against the lower nip bar where it is retained by a vacuum which acts upon the web through holes in the nip bar. The operator can thus quickly and easily align the web, trim its leading edge and prepare that edge margin with double-faced adhesive in the usual way. Following such preparation, the lower nip bar is returned to its ready position and the upper carriage and knife carriage returned to their normal advanced positions so that the two nip bars are disposed opposite one another. In this condition of the splicer head, the running web still travels around the upper idler roller between the two nip bars and on to the web-consuming machine. The prepared leading edge of the ready web is now located under the running web and still adhered to the lower nip bar.

When the running web is about to expire, the machine automatically or the operator manually initiates a splice sequence which causes the splicer to automatically brake the running web to a halt. As soon as the running web reaches a selected minimum speed, e.g. zero speed, the upper nip bar piston is actuated to urge the upper nip bar against the lower nip bar thereby pressing the now-stationary running web against the prepared leading edge of the ready web, thereby adhering that edge to the running web. Immediately thereafter, the knife cylinder is actuated momentarily to shift the knife bar to its cutting position so that its edge advances into the brush mounted to the upper nip bar. In so doing, the knife edge severs the running web at a location right adjacent to the engaged edges of the nip bars just upstream from the splice. As soon as the knife bar retracts, the upper nip bar is retracted to its ready position and the web traveling through the splicer is accelerated up to line speed with web now being drawn from the lower web roll.

During the aforesaid splice ready sequence, when the web is slowed and stopped, the web-consuming machine draws down the web stored in the splicer accumulator so that there is no interruption of the operation being performed on the web by that machine. Following completion of the splice sequence as aforesaid, the web passing through the splicer head may be accelerated to a rate somewhat above line speed to refill the accumulator with web in preparation for the next splice sequence.

Now that web is being drawn through the splicer around the lower idler roller, the operator can replace the empty roll core and replace it with a fresh web roll. Another web preparation sequence can now be initiated. In this case, however, the lower splicer head carriage is retracted along with the knife carriage permitting the upper nip bar to be swung to its preparation position adjacent the web prep plane. The leading edge of the upper web roll is positioned against that bar being maintained there under vacuum and prepared in the usual way following which the upper nip bar is swung back to its ready position and the lower carriage and knife carriage are returned to their normal advanced positions.

Again the prepared leading edge of the ready, i.e. upper, web is located between the two nip bars right adjacent the running web. When the lower web roll is about to expire, the next splice sequence is initiated causing the running web traveling around the lower idler roller to brake to a halt. As soon as the web is stopped, the lower nip bar piston is actuated causing the lower nip bar to press the running web against the prepared leading edge of the ready web adhered to the upper nip bar. Then the knife bar is actuated so as to sever the running web just upstream from the splice following which the lower nip bar is retracted and the web accelerated up to speed as described above with the web now being drawn around the upper idler roller.

It is important to note that when the splicer head carriages are in their normal advanced positions, the idler rollers separate the accessible web prep plane from the potentially dangerous components of the splicer head including the knife bar and the nip bars. Also, when the operator is preparing the leading edge of a ready web, that is accomplished on either the upper or lower nip bar only when that bar is right at the web prep plane in front of the splicer head. Moreover, while that web preparation process takes place, the opposite carriage and the knife carriage are both in retracted positions set back appreciably from the web prep plane. Accordingly, the operator is still shielded from the dangerous splicer parts not only by the nip bar on which he is preparing the ready web but also by the retracted idler roller around which the running web is traveling through the splicer head.

The inclusion in the splicer head of nip bars which move vertically to effect a splice and a knife bar which travels horizontally to sever the running web upstream from the splice also means that the running web can be cut very close to or even at the splice between the two webs. Accordingly the present splicer is able to produce splices with very short tails and even lap splices with no tail in the event that is desired.

Also, the relative position of the operative nip bar and the knife bar assures that the web is severed reliably across its full width when each splice is made. In this, the pressing together of the nip bars during each splice ready sequence captures and tensions the now stationary running web across the path of the knife bar cutting edge. Therefore, when the knife bar is moved to its cutting position, it presses the web against the knife brush or backup on the operative nip bar so that the web is oriented essentially face-on to the knife edge assuring a good clean perpendicular cut all across the web.

Yet with all of these advantages, the splicer is relatively simple, its head being composed of only three main sections two of which are mirror images of one another and so can be composed of essentially the same parts. Therefore, the costs of making the apparatus and of maintaining a parts inventory therefor are kept to a minimum. Also, since it does have a relatively simple construction, the apparatus should suffer minimum downtime. Those factors, coupled with the fact that the operator can prepare the ready web for splicing very quickly and easily, should also make the overall machine quite efficient to operate.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figures 1, 3:
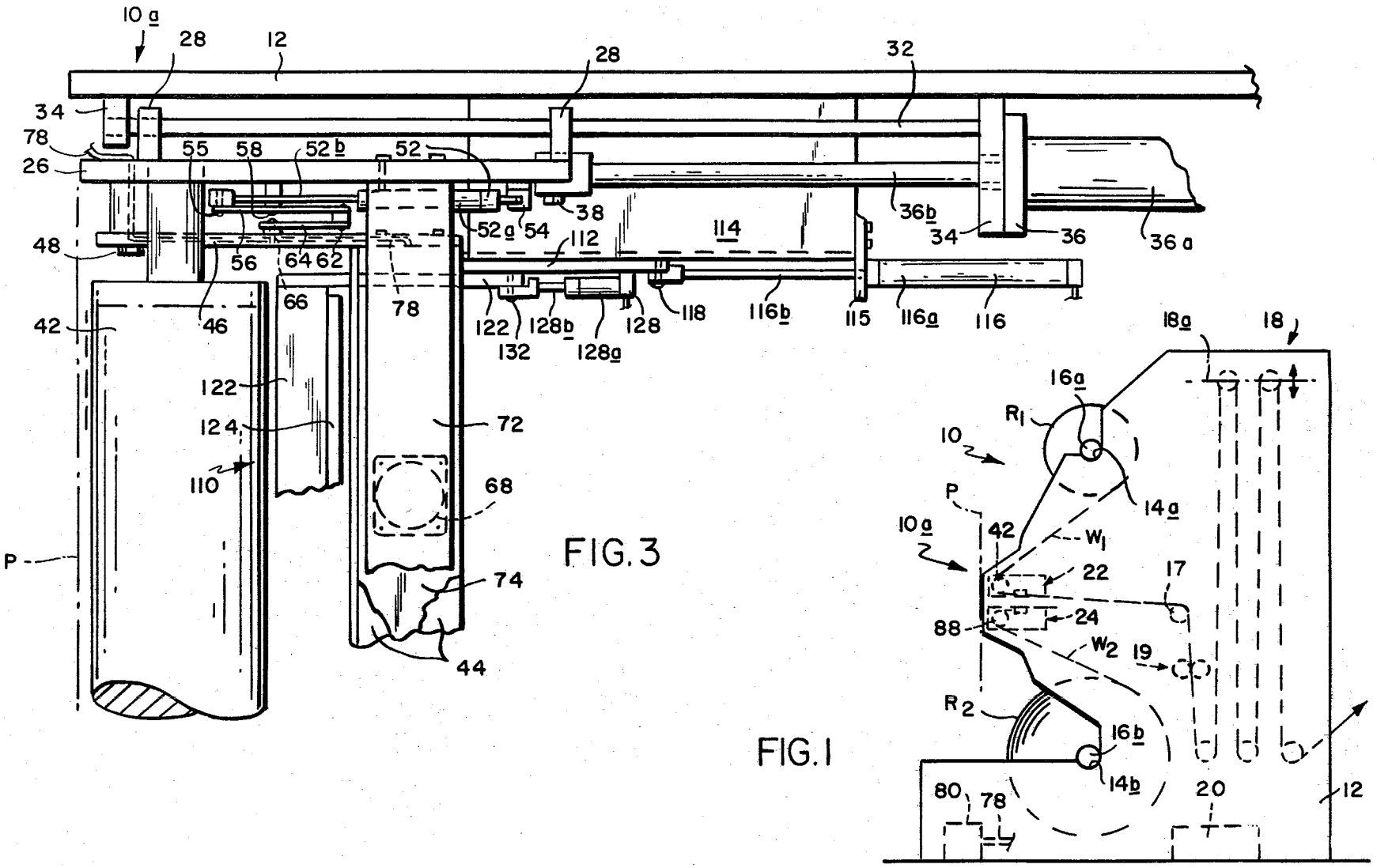
FIG. 1 is a schematic left-side elevational view of the splicer apparatus made in accordance with this invention.
FIG. 3 is a fragmentary top plan view of that splicer head section.

Referring to FIG. 1 of the drawings, the splicer indicated generally at 10 has a pair of spaced-apart side plates 12 which removably and rotatively support at upper and lower locations 14*a* and 14*b* thereon a pair of shafts 16*a* and 16*b*. These shafts carry web rolls $R_1$ and $R_2$ having webs $W_1$ and $W_2$ extending therefrom. As is customary with apparatus of this type, provision (not shown) is made for braking shafts 16*a* and 16*b* in the customary way.

Splicer 10 is normally used in conjunction with a web-consuming machine such as a printing press (not shown) to supply the web needs of that machine so that the machine can operate continuously. That is, web from one of the rolls, say roll $R_1$ is fed by way of an idler 17 to the web-consuming machine. When that roll is about to expire, the running roll 16*a* is braked to a halt and the trailing end of the web $W_1$ from that roll is spliced to the leading end of the web $W_2$ from roll $R_2$ in the splicer's splicer head 10*a*. Then the new roll $R_2$ is accelerated up to line speed so that the web-consuming machine now draws its web requirements from roll $R_2$. Usually also a web accumulator shown generally at 18 having the usual dancer 18*a* is located between the splicer head 10*a* and the web-consuming machine so that when the web roll in the splicer is braked to a halt during splicing, the web-consuming machine can temporarily obtain its web requirements by drawing down the supply of web stored in accumulator 18. Then after the splice is completed, the web entering the accumulator 18 can be accelerated to a speed slightly greater than line speed by a driven roller couple shown generally at 19 downstream from idler 17 to refill the accumulator 18 in preparation for the next splice. A controller 20 controls all of the various automatic operations of the apparatus to be described.

Figure 2:
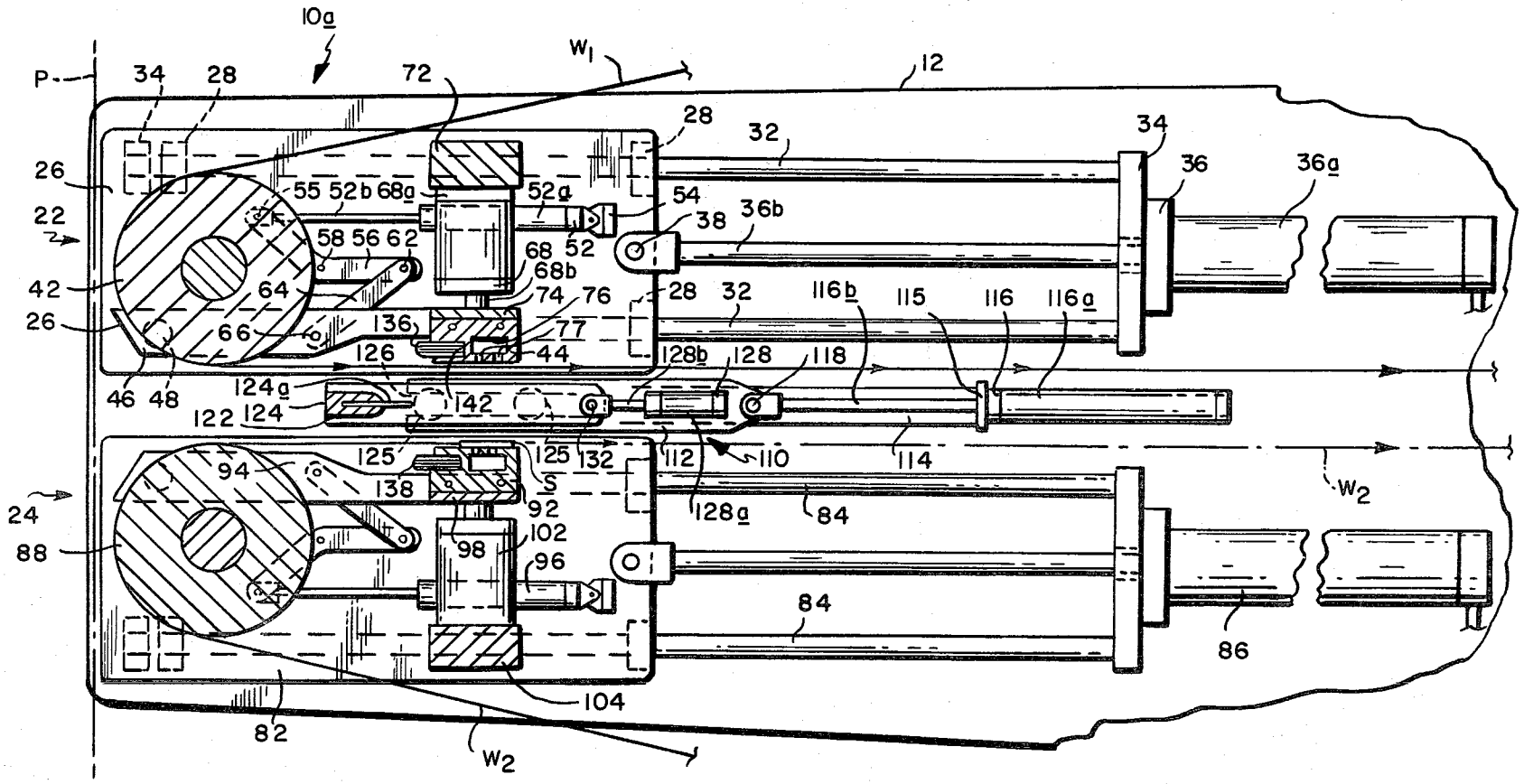
FIG. 2 is a vertical sectional view on a larger scale of the splicer head section of the FIG. 1 apparatus.

Referring now to FIGS. 1 to 3, the splicer head 10*a* supports a pair of opposing more or less mirror image traveling upper and lower nip bar carriages indicated generally at 22 and 24. Normally, the front edges of those carriages are located at the front of head 10*a* adjacent to an imaginary vertical web preparation plane shown at P. As best seen in FIGS. 2 and 3, the components of the upper carriage 22 are supported by a pair of generally rectangular end plates 26. Each end plate has sliders 28 at its opposite ends which slide on horizontal guide rods 32 connected at their opposite ends by brackets 34 to the inside walls of frames 12. Thus, carriage 22 can travel on rods 32 from a normal advanced location wherein the carriage is situated adjacent the web prep plane P at the front of head 10*a* to a location wherein the carriage is set back appreciably from that plane. Carriage 22 is moved between its two positions by a pair of pneumatic pistons 36 whose cylinders 36*a* are mounted to the right-hand frame brackets 34 and whose rods 36*b* are connected at 38 to the carriage end plates 26.

Journaled in carriage end plates 26 adjacent the front edges thereof is an idler roller 42 which receives the web $W_1$ from web roll $R_1$. Spaced behind or to the right of roller 42 is a long generally rectangular nip bar 44. Bar 44 is supported at its opposite ends by a pair of arms 46 whose opposite ends are connected by pivots 48 to the carriage end plates 26. The location of the pivots and the length of the arms are such that nip bar 44 can be swung from a location adjacent the lower edges of end plates 26 downstream from roller 42 to a location wherein the nip bar is located well below end plates 26 at the web preparation plane P right at the front of splicer head 10*a*.

Bar 44 is moved between its two positions by a pair of pistons 52 whose cylinders 52*a* are pivotally connected to brackets 54 projecting out from the inboard faces of carriage plates 26 adjacent the right-hand edges thereof. The rods 52*b* of those pistons extend toward the front of the splicer head and are pivotally connected at 55 to corresponding first ends of bent links 56 connected by pivots 58 to plates 26. The opposite ends of links 56 are connected by pivots 62 to ends of straight links 64 whose opposite ends are connected by pivots 66 to the nip bar arms 46 midway along their lengths. The piston and links are arranged and adapted so that, when the piston rods 52*b* are retracted, the nip bar arms 46 are moved downwards, thereby swinging the nip bar 44 from its ready position shown in FIG. 2 to its web preparation position at plane P.

Still referring to FIGS. 2 and 3, when the nip bar 44 is in its ready position illustrated in FIG. 2, provision is made for shifting that bar downwards during a splicing operation. In the illustrated embodiment of the invention, this downward pressure to the nip bar 44 is applied by a pair of pistons 68 whose cylinders 68*a* are suspended from the underside of a beam 72 supported between carriage end plates 26 directly above nip bar 44. The piston rods 68*b* extend downwards and are connected to the opposite ends of a rigid strap 74 which, when the piston rods are in their retracted positions, lies flush against the top of nip bar 44. When pistons 68 are actuated and their rods extended, the nip bar 44 is shifted from its normal ready position downward relative to its arms 46 to a splice position wherein it extends appreciably below the carriage 22 (See FIG. 4E). To provide this movement, the bar is vertically slidably connected to its arms by means not shown and is normally maintained by springs (not shown) in its upper ready position.

During web preparation and splicing, the leading edge of the ready web must be adhered to the nip bar 44. To accomplish this, the bar is formed along its length with an internal passage or chamber 76 and a multiplicity of holes 77 extending from that chamber to the lower working surface of the nip bar as shown in FIG. 2. As best seen in FIG. 3, a conduit or pipe 78 leads from chamber 76 at the right-hand end thereof along the right-hand nip bar arm 46 and through pivot 48 to the exhaust side of a blower 80 (FIG. 1). A vacuum is present in bar 44 as long as carriage 22 is in its advanced position shown in FIG. 2. A blower is used to form the vacuum in bar 44 because we have found that sufficient vacuum can be developed at holes 77 therein to securely adhere web thereto without having to cover unused holes with tape.

Referring now to FIG. 2, as stated previously, the lower carriage 24 is a mirror image of carriage 22. Thus, carriage 24 includes a pair of end plates 82 which slide on horizontal guide rods 84 between advanced and retracted positions corresponding to those of carriage 22 under the control of pistons 86. Carriage end plates 82 support an idler roller 88 and a nip bar 92 pivotally connected to the end plates by arms 94. The nip bar 92 can be swung by a piston 96 between a ready position shown in FIG. 2 wherein it lies adjacent the top of carriage 24 downstream from roller 88 and a web preparation position wherein the bar is located appreciably above carriage 24 at the web prep plane P (See FIG. 4B). Bar 92 can also be shifted upwards relative to its arms 94 from its normal ready position illustrated in FIG. 2 to a splicing position wherein it projects appreciably above carriage 24 by a rigid strap 98 driven against the underside of bar 92 by pistons 102 projecting up from a beam 104 connected between carriage end plates 82. Like bar 44, bar 92 is formed with an internal chamber and vacuum holes for adhering ready web to the bar during web prepping and splicing.

As best seen in FIG. 2, when carriages 22 and 24 are both in their advanced position, their idler rollers 42 and 88 on the one hand and their nip bars 44 and 92 on the other are in vertical alignment. Also in that condition of the splicer head, when one of the nip bar pistons, say piston 68 is actuated, the throw of the piston is sufficient to shift the upper nip bar 44 downwards into positive engagement with the lower nip bar 92. Likewise, when the piston 102 on the lower carriage is actuated, the lower nip bar 92 is pressed firmly against the upper nip bar 44. It should be clear also that each carriage 22, 24 is retracted by its pistons 36 or 86 to provide sufficient clearance to enable the nip bar on the opposite carriage to be swung between its ready and web preparation position described above.

Still referring to FIGS. 2 and 3, the third major section of the splicer head 10*a* is a knife carriage indicated generally at 110. Carriage 110 includes a pair of long narrow end plates 112 which are slidably keyed or dovetailed into the edges of a pair of long rigid plates 114 projecting in from the adjacent apparatus side frames 12. Carriage 110 is slidable between an advanced position shown in FIG. 2 wherein it extends between the nip bars 44 and 92 and a retracted position wherein the carriage 110 is displaced to the right sufficiently to provide clearance for either the nip bar 44 or 92 to be swung to its web prep position at plane P (See FIG. 4A). Carriage 110 is moved between its two positions by a pair of pistons 116 whose cylinders 116*a* are mounted to brackets 115 anchored to the right-hand ends of plates 114. The rods 116*b* of the pistons are connected at 118 to the right-hand ends of the knife carriage end plates 112.

The slidable knife carriage end plates 112 themselves slidably support a pair of arms 122 connected to the opposite ends of a knife bar 124 having a knife edge 124*a* facing away from plane P. As best shown in FIG. 2, the slidable connection between arms 122 and plates 112 is provided by wheels 125 projecting from the outboard sides of arms 122 which roll in slots 126 formed on the inboard sides of end plates 112. The knife bar 124 and its arms 122 are moved along carriage end plates 112 by pistons 128 whose cylinders 128*a* are mounted to end plates 112 and whose pistons 128*b* are connected by pivots 132 to the right-hand ends of arms 122.

When all of the carriages 22, 24 and 110 are in their advanced positions illustrated in FIGS. 2 and 3, the knife bar 124 and more particularly its edge 124*a* is normally located between nip bars 44 and 92 just to the left of those bars. However, during a splice sequence to be described presently, pistons 128 can be actuated to shift the knife bar 124 on its carriage to the right as viewed in FIGS. 2 and 3. Normally, this occurs when one of the nip bars 44 or 92 is in its splicing position so that the knife edge 124*a* actually intercepts the operative nip bar. To provide for this, knife brushes or backups 136 and 138 seated in slots provided in nip bars 44 and 92 respectively. As best seen in FIG. 2, these brushes 136 and 138 project out somewhat from the sides of the nip bars and are located very close to the opposing faces of those bars.

Figure 4A:
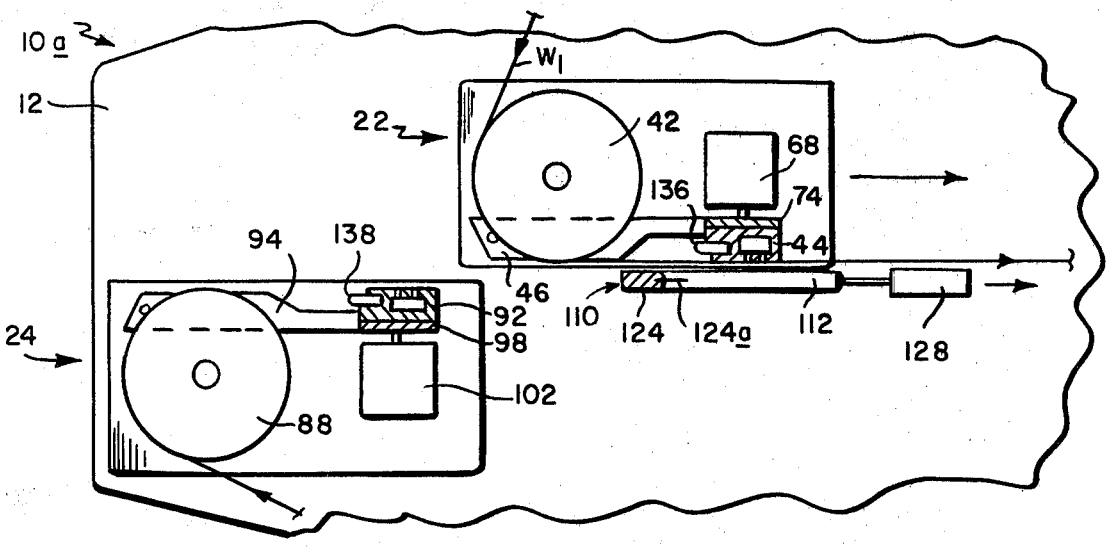
FIGS. 4A to 4G are schematic left-side elevational views illustrating the operation of the splicer head section of the FIG. 1 apparatus.
Figure 4B:
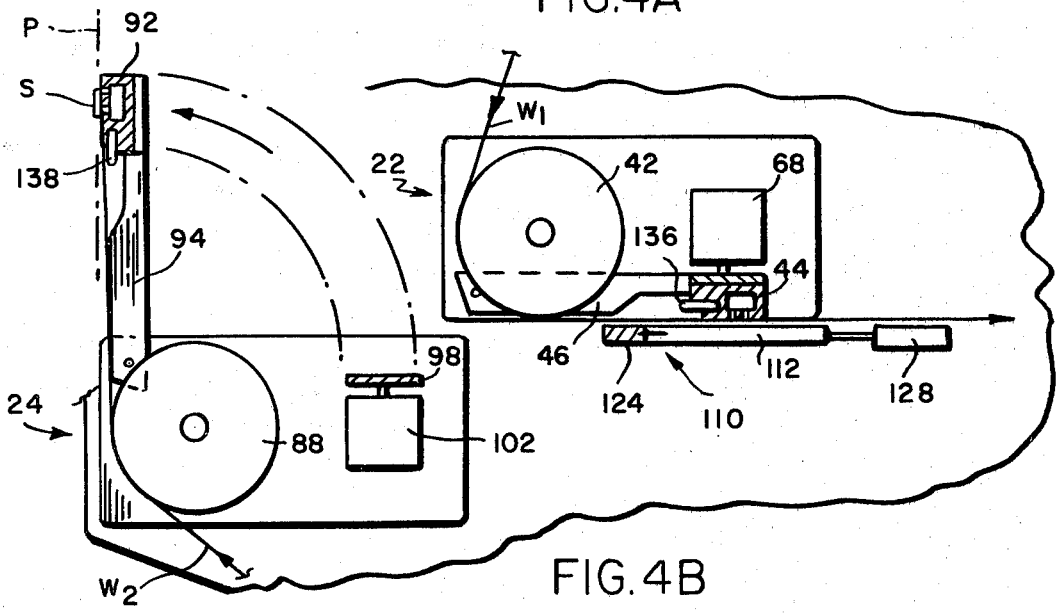

Turning now to FIGS. 4A to 4G, the splicer head 10*a* comes into play when one of the web rolls in the splicer apparatus 10 is about to expire. Assume, for example, that web $W_1$ drawn from roll $R_1$ is the running web traveling to the web-consuming machine. Initially, all three carriages 22, 24 and 110 are in their advanced positions illustrated in FIGS. 2 and 3 and the web $W_1$ is trained around idler roller 42 of the carriage 22 passing between nip bars 44 and 92 on its way to idler roller 17 (FIG. 1). Assume also that the operator has just placed a fresh web roll $R_2$ at the lower roll position 14*b* on the apparatus 10 and wishes to prepare the leading edge of the web $W_2$ from that roll for splicing to the running web $W_1$. To accomplish that, the operator initiates a web prep sequence which causes the apparatus controller 20 (FIG. 1) to actuate the upper nip bar piston 36 which retracts the upper carriage 22 and also piston 116 which retracts the knife carriage 112 to the right sufficiently to clear the nip bar 92 on the lower carriage 24 as seen in FIG. 4A. Following that step, the controller 20 actuates piston 96 on the lower carriage so as to swing the lower nip bar 92 from its ready position to its web prep position at plane P as shown in FIG. 4B. With the bar in that position, the operator draws web $W_2$ from the ready roll $R_2$ and positions the leading edge margin of that web against the vacuum surface of the nip bar 92 which is readily accessible at plane P right at the front of the splicer head 10*a*. Thus, the operator can easily align the web properly on the bar and trim the leading edge of the web and prepare the leading margin with the usual double-faced adhesive tape strip 5 quite quickly and easily.

Figure 4C:
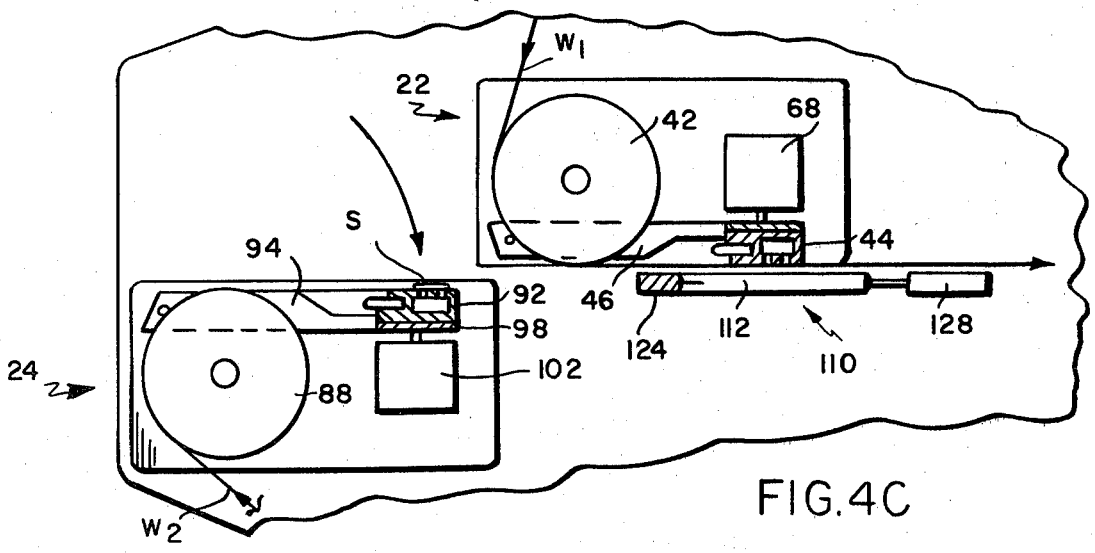
Figure 4D:
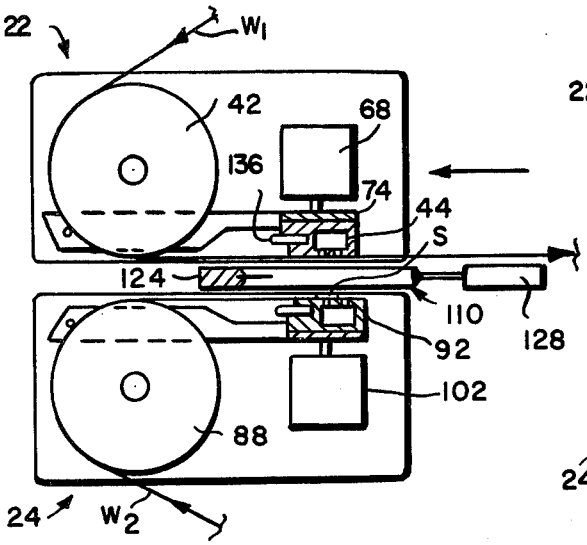

Furthermore, the preparation of the web takes place quite far away from the potentially dangerous components of the head including the running web $W_1$ engaged around the retracted idler roller 42 and the knife bar 124 which components have been retracted out of the way prior to the preparation step. Upon completion of web prep, the operator initiates a splice sequence which causes the controller 20 to actuate piston 96 to swing nip bar 92 back to its ready position as shown in FIG. 4C following which the controller actuates pistons 36 and 116 to return the upper nip bar carriage 22 and the knife carriage 110 to their advanced positions as shown in FIG. 4D. In those positions, the nip bars 44 and 92 are vertically aligned with the running web $W_1$ traveling between the nip bars and the prepared leading edge of the ready web $W_2$ and its exposed tape strip 5 being held against the upper face of the lower nip bar 92.

Upon the return of the carriages as aforesaid, the controller reverts to an automatic splice mode wherein it monitors the amount of web remaining on the running roll $R_1$. When the web from that roll has or is about to expire, the controller initiates a splice sequence. Means for detecting expiration of a roll of running web and initiating a splice sequence are well known, examples being described in U.S. Pat. Nos. 3,973,174 and 3,990,647 owned by the assignee of the present application.

Figure 4E:
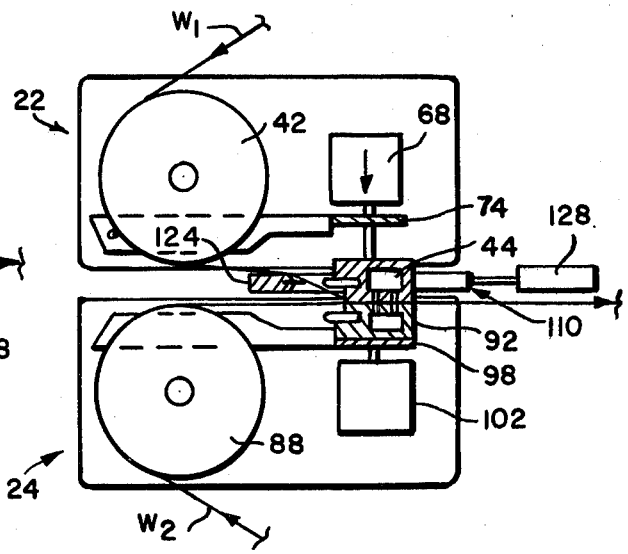
Figure 4F:
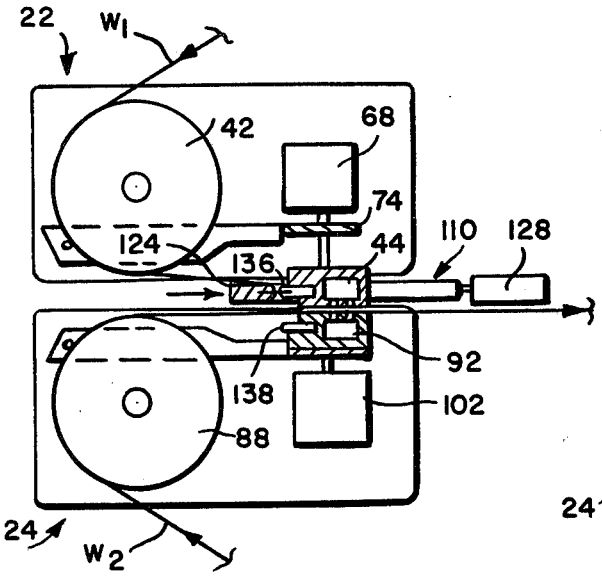

Upon initiation of the splice sequence, the running web $W_1$ is braked to a halt by any conventional means. As soon as the running web reaches a selected minimum speed or zero speed, the controller 20 actuates the upper nip bar piston 68 to push nip bar 44 downwards towards the lower nip bar 92 thereby pressing the now stationary web $W_1$ against the double-faced adhesive strip S thereby splicing the two webs together as shown in FIG. 4E. Immediately thereafter, while the nip bar 44 is in its splicing position, the knife piston 128 is actuated momentarily thereby advancing the knife bar 124 toward nip bar 44 so that the knife edge 124*a* projects through the web $W_1$ into the knife backup or brush 136 thereby severing the web $W_1$ just upstream from the splice between the two webs as shown in FIG. 4F.

Figure 4G:
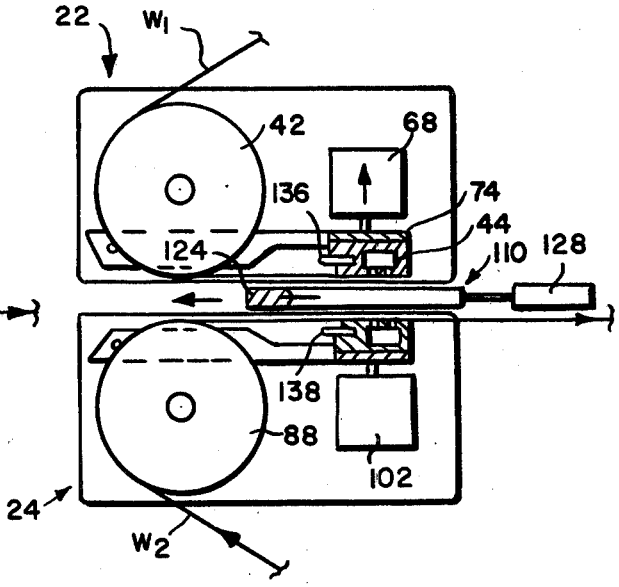

Immediately upon the retraction of the knife bar 124, the piston 68 is retracted so that nip bar 44 returns to its ready position as shown in FIG. 4G. The web entering festoon 18 (FIG. 1) is now accelerated by accelerating roll couple 19 so that the accumulator 18 is refilled with web now drawing from the roll $R_2$ while web proceeds uninterruptedly from the accumulator into the web-consuming machine thereby completing the splice sequence.

As web $W_2$ is being drawn from roll $R_2$ through the splicer head 10*a*, the operator can now replace the core of the expired roll $R_1$ at the upper splicer position 14*a* with a fresh roll. The operator initiates a web prep sequence and prepares the leading edge of that web for the next splice operation which proceeds in more or less the same way described above. That is, the pistons 86 and 116 are actuated to retract the lower carriage 24 and knife carriage 110. Then the upper nip bar 44 is swung to its prep position at plane P. The operator then draws web from the new upper roll and aligns its leading edge margin on the vacuum nip bar 44. The web leading edge is trimmed and a double-faced adhesive strip S is applied to that edge margin following which the nip bar 44 is returned to its ready position as the lower carriage 24 and knife carriage 110 are returned to their advanced positions.

Upon expiration of the roll $R_2$, the running web $W_2$ is braked to a halt, the lower nip bar piston 102 is actuated thereby pressing the lower nip bar 92 against the upper nip bar 44 with the two webs between them. Then the knife piston 128 is actuated to cause the knife bar 124 to sever the web $W_2$ just upstream from the splice. Following that, the upper nip bar is retracted and the web entering the accumulator is accelerated back up to speed as before now drawing from the fresh roll in the upper roll position 14*a* of the splicing apparatus. It is obvious from the description herein that the same advantages described above, namely convenient web preparation and operation safety also apply when prepping web as aforesaid on the upper nip bar 44.

Because of the construction of the present splicer head 10*a*, the web cutting knife 124 can be located very close to the opposing faces of the nip bars 44 and 92 which press the two webs together to effect a splice. This means that a splice can be created with a very short tail. Indeed, if the leading edge of the ready web is prepared so that the double-faced adhesive strip S extends slightly to the left of the nip bars, there will be essentially no tail at all because the small length of severed web between the nip bars and the cut edge of that web tends to be pressed down against that extra strip S length when the splice is pulled around idler roller 17 (FIG. 1) and the various other rollers downstream from the splicer head.

Also, it is apparent from FIGS. 4E and 4F that when the nip bar 44 or 92 is moved to it splicing position, the running web to be cut is tensioned between the knife bar and the nip bars as shown in FIG. 4E. Then when the knife bar 124 commences its cut, the knife edge 124*a* bears against the web causing it to assume a position more or less at right angles to the knife blade. Consequently, the knife cuts through the web at right angles assuring a quick clean cut along the entire width of the web.

Thus, with a splicer head 10*a* comprising a relatively few number of reliable different parts, the present apparatus 10 is able to splice webs quickly and reliably so that web from a succession of rolls can be supplied continuously to a web-consuming machine such as a printing press. For the same reason, the present apparatus should suffer minimum downtime due to parts failure or malfunction. Consequently, the costs of manufacturing and maintaining the apparatus should be a minimum.

Furthermore, the apparatus allows the operator to prepare ready web at a very convenient location right at the front of the splicer and when doing that he is unlikely to encounter any sharp or moving components that could cause pinching or cutting injuries to the operator. Therefore, the present apparatus should find wide application whenever it is necessary to splice together webs of cloth, paper or the like either for serving the continuous needs of a web-consuming machine or for splicing together successive lengths of web for winding on a roll in a web winder.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. Web splicing apparatus of the type having a splicer head for splicing the leading edge of a ready web to a second web and wherein the carriage includes a frame characterized in that the splicer head has a pair of opposing carriage assemblies movably mounted to the frame for movement along parallel tracks between advanced positions adjacent to the front of the splicer head and retracted positions, each carriage assembly comprising an idler roller for receiving web from a web roll mounted on the splicer, a nip bar positioned parallel to the idler roller, means for swingably mounting the nip bar to the carriage so that the bar is swingable between a ready position wherein the bar is located downstream from the corresponding idler roller and a web preparation position at the front of the splicer head when the opposite nip bar carriage is in its retracted position and nip bar actuating means for shifting the bar from its ready position toward the nip bar on the opposite carriage, a knife carriage assembly movably mounted to the frame, said knife carriage assembly being movable parallel to the nip bar carriages between an advanced position and a retracted position, knife means supported by the knife carriage assembly and movable between a retracted position wherein the knife means is positioned between and just forwardly of said ready nip bars and an advanced position wherein the knife means intercepts one of said nip bars when that bar is in its splicing position, means mounted on the knife carriage assembly for momentarily urging the knife means from its retracted to its advanced position, and means for controlling the movements of said carriages, nip bars and knife means between their various operative positions.

2. The apparatus defined in claim 1 and further including a web accumulator for receiving web from the splicer head.

3. The apparatus defined in claim 1 wherein the two idler rollers and the two nip bars are in vertical alignment when the two nip bar carriages are in their advanced positions.

4. The apparatus defined in claim 1 wherein the means for moving each nip bar between its ready and web preparation positions comprise a pair of arms whose corresponding first ends are connected to opposite ends of the bar and whose corresponding second ends are pivotally connected to the carriage adjacent the front of the splicer head.

5. The apparatus defined in claim 4 wherein the connections between the bars and the corresponding arm ends permit vertical movements of the bars relative to their arms between the ready and splicing positions of the bars, and means for biasing the bars to their ready positions.

6. The apparatus defined in claim 1 and further including knife back-up means mounted on the forward wall of each nip bar adjacent the working face of the nip bar for receiving the knife means when that nip bar is in its splicing position and the knife means are moved to their advanced position.

7. The apparatus defined in claim 1 wherein each nip bar is formed with an internal chamber and a multiplicity of holes extending from the chamber to the working face of the bar opposite the other nip bar and means for maintaining said chamber under a vacuum so that web is adhered to the working face of the nip bar by the negative pressure at said holes.

8. The apparatus defined in claim 7 wherein the vacuum-maintaining means comprise a blower and a conduit connected between each said chamber and the intake side of the blower.

* * * * *